US005437119A

United States Patent [19]

Womack

[11] Patent Number: 5,437,119

[45] Date of Patent: Aug. 1, 1995

[54] GUN TRIGGER BLOCKING STRUCTURE

[75] Inventor: Robert C. Womack, Dallas, Tex.

[73] Assignee: Weinraub Enterprises, Inc., Orange, Calif.

[21] Appl. No.: 291,198

[22] Filed: Aug. 16, 1994

[51] Int. Cl.[6] ..... F41A 17/54

[52] U.S. Cl. ..... 42/70.07

[58] Field of Search ..... 42/70.07

[56] References Cited

U.S. PATENT DOCUMENTS

| | | | |
|---|---|---|---|
| 3,624,945 | 12/1971 | Foote | 42/70.07 |
| 3,956,842 | 5/1976 | Ballenger | 42/70.07 |
| 4,030,221 | 6/1977 | Doobenen et al. | 42/70.07 |
| 4,499,681 | 2/1985 | Bako et al. | 42/70.07 |
| 4,509,281 | 4/1985 | Dreiling et al. | 42/70.07 |
| 5,153,360 | 10/1992 | Upton | 42/70.07 |
| 5,191,158 | 3/1993 | Fuller et al. | 42/70.07 |

*Primary Examiner*—Charles T. Jordan
*Assistant Examiner*—Theresa M. Wesson
*Attorney, Agent, or Firm*—Harold L. Jackson

[57] ABSTRACT

A pseudo lock gun trigger blocking structure deterring children and uninformed adults from being able to work the trigger and shoot a handgun, rifle or shotgun. A pseudo key member that has the outward appearance of a lock key tumbler is mounted in a first block half to extend to the interior thereof with an opening therethrough having buttress thread engaging grooves on the back side of the opening. The pseudo key member is resiliently biased by an internal spring to an outer position but is resiliently pushable inwardly to an inwardmost position when permitted by a blocking pin being pushed in to an unblocking position against the resilient bias of a spring to permit movement of the pseudo key member to its innermost position. A second block half mounts a pin locking rod that is fixed in its mounting and provided with buttress threads on the outer end insertable into an opening in the first block half where it is captured by engagement with the grooves on the back side of the opening in the extension of the pseudo key member. Release is accomplished when the pseudo key member is pushed to the innermost position. Pins adjustable positioned to prevent operation of a gun trigger extend from the second block half to the first block half.

31 Claims, 3 Drawing Sheets

GUN TRIGGER BLOCKING STRUCTURE

BACKGROUND OF THE INVENTION

1. Field of the Invention

This invention relates in general to firearm safety devices, and more particularly, to an adjustable trigger blocking structure.

2. Description of the Related Art

Young children in particular are attracted to guns, and many have a great curiosity with respect thereto. While an adult may think a gun is safely put away, children many times will find a way to get to them and handle them. A gun is not a plaything and should be used carefully in a responsible manner. Further, availability and use of a gun should be denied to an intruder, and yet the gun should be readily available for the home owner in meeting emergency situations.

Locking devices which clamp around the trigger guard of a gun for preventing access to the trigger have been used in the past. However, such locking devices generally employ a key lock which can be opened only with a key, the key may not be close at hand if the gun is needed to meet an emergency situation. There is a need for a gun lock which renders the gun substantially unaccessible to children while allowing the owner to quickly disable the lock without a key should an emergency arise.

SUMMARY OF THE INVENTION

It is, therefore, a principal object of this invention to provide a gun trigger blocking structure that prevents use of a gun in that the trigger is prevented from moving.

Another object is to provide such a gun trigger blocking structure with the appearance that a key be required for separation and removal thereof.

A further object is to provide such a gun trigger blocking structure with adjustable positioned cross pins that are positionable in adapting the structure for use with an extensive range of handguns, rifles or shotguns.

Still another object is to provide protection for children from injuring themselves or others with guns.

Another object is to provide such a gun trigger blocking structure that is easily and quickly removable by the gun owner when the gun is needed in hurry even in the dark.

A further object is to deter theft of a gun.

Features of the invention useful in accomplishing the above objects preferably include, in a gun trigger blocking structure, a pseudo key member that has the outward appearance of a lock key tumbler mounted in a first block half with its key tumbler preferably having an extension to the interior thereof with an opening through the extension having locking means such as thread engaging grooves on the back side of the opening. The pseudo key member is resiliently biased by an internal spring to an outer position but is resiliently pushable inwardly to an inner limit position when permitted by otherwise blocking pin being pushed into an unblocking position against the resilient bias of a spring to permit movement of the pseudo key member to its inner limit position. A second block half mounts a locking rod that is fixed in its mounting and provided with buttress threads on the outer end insertable into an opening in the first block half where it is captured by engagement with the grooves on the back side of the opening in the extension of the pseudo key member.

Release of the locking rod for separation of the two block halves is accomplished when the pseudo key member is pushed to the innermost position and the buttress threads on the locking rod are clear of the buttress thread engaging grooves in the pseudo key member extension opening. Pins adjustably positioned to prevent operation of a gun trigger extend from the second block half to the first block half.

A specific embodiment representing what is presently regarded as the best mode of carrying out the invention is illustrated in the accompanying drawings.

DESCRIPTION OF THE PREFERRED EMBODIMENT

Figure 1:
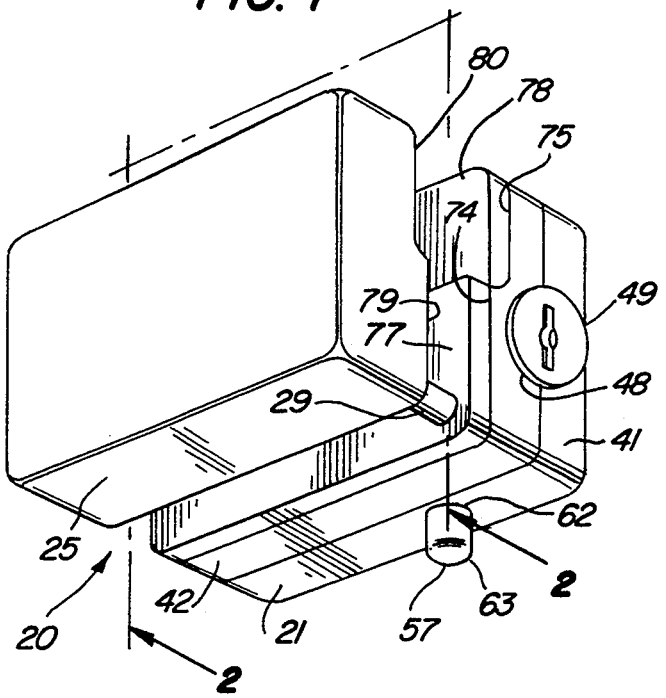
FIG. 1 represents a perspective view of the assembled gun trigger blocking structure.
Figure 10:
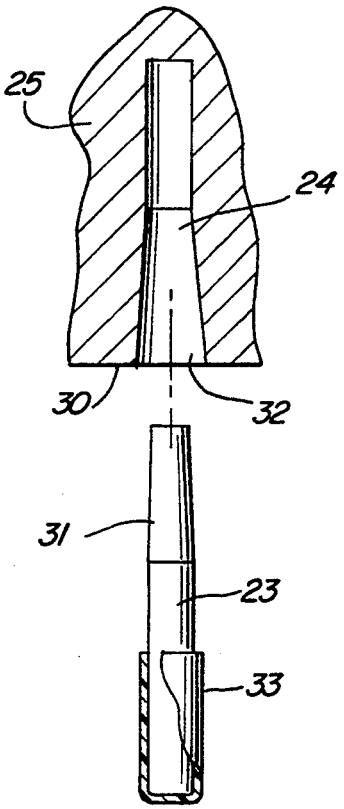
FIG. 10 is a partial broken away detail showing of a trigger blocking pin any number of which are insertable into openings therefor in one of the two gun trigger blocking structure halves separated from each other.
Figure 2:
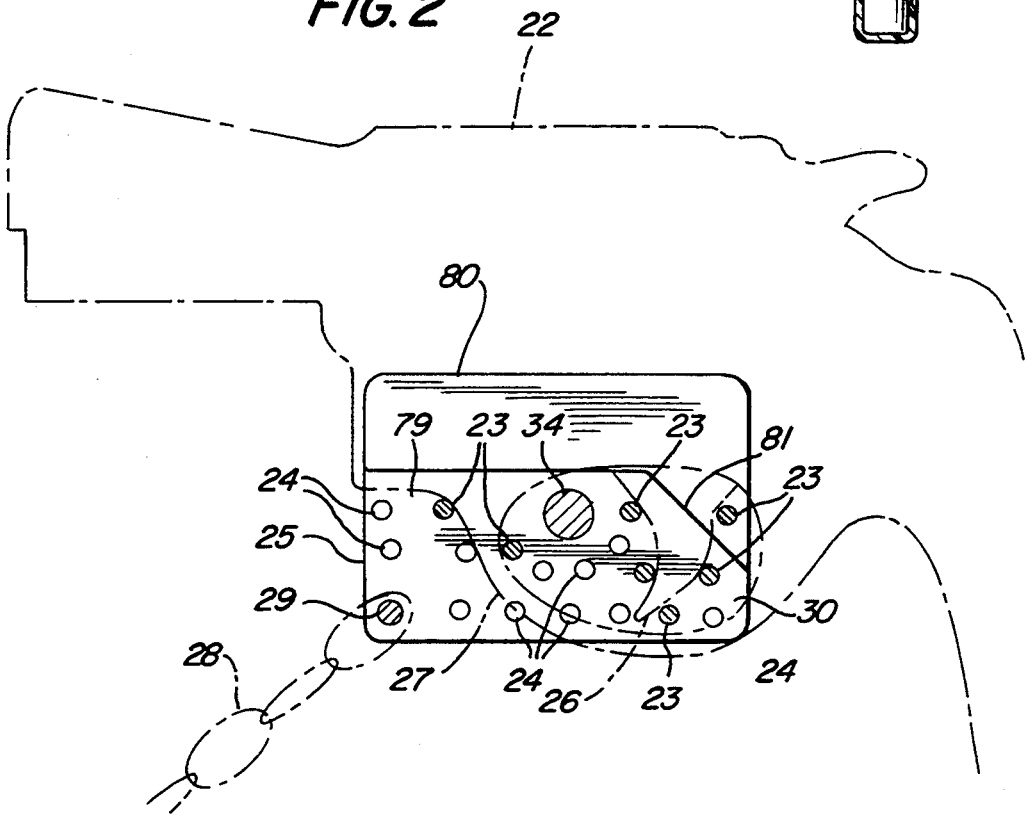
FIG. 2 is a side elevation cut away and sectioned view taken along line 2—2 of FIG. 1 showing the trigger blocking structure as positioned on a gun (shown in phantom) and with security chain (also in phantom) connected to a corner pin of the structure.

The pseudo lock gun trigger blocking structure of FIG. 1 has, in FIG. 2, the pseudo lock half 21 lifted away to show detail of the structure as positioned on a handgun 22 with pins 23 selectively positioned in various pin holes 24 in locking structure half 25 about the gun trigger 26 to prevent trigger movement and to aid in positioning of the trigger blocking structure 20 relative to the trigger 26 and trigger finger guard 27. A security chain 28 or cable connected to a cover pin 29 of the trigger blocking structure 20 extends to solid connection with a fixed in place fixture (detail not shown) as a deterrence to theft of the gun 22. More pin holes 24 are provided in locking structure half 25 on the inner face 30 thereof to provide an adequate range of placements of pin 23. The pins 23 that are approximately one inch long are provided with a conical insert section 31 that is readily insertable into the conical entrance section 32 of pin holes 24, and the pins 23 can be provided with plastic cup covers 33 as shown in FIG. 10.

Figure 3:
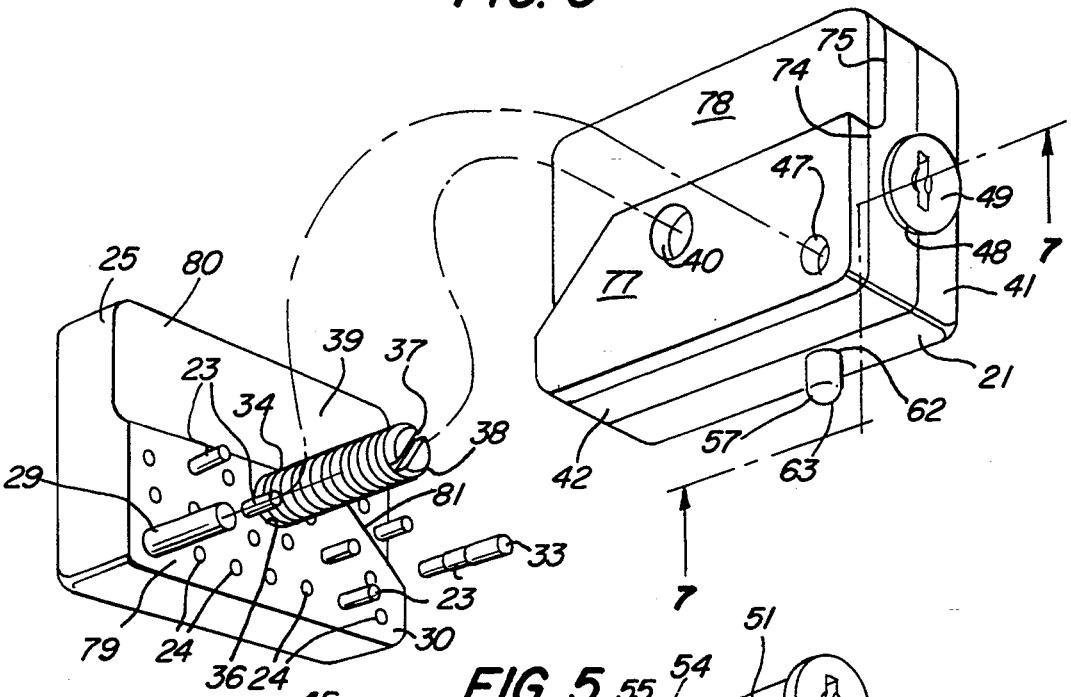
FIG. 3 is a perspective view of the two gun trigger blocking structure halves separated from each other.
Figure 4:
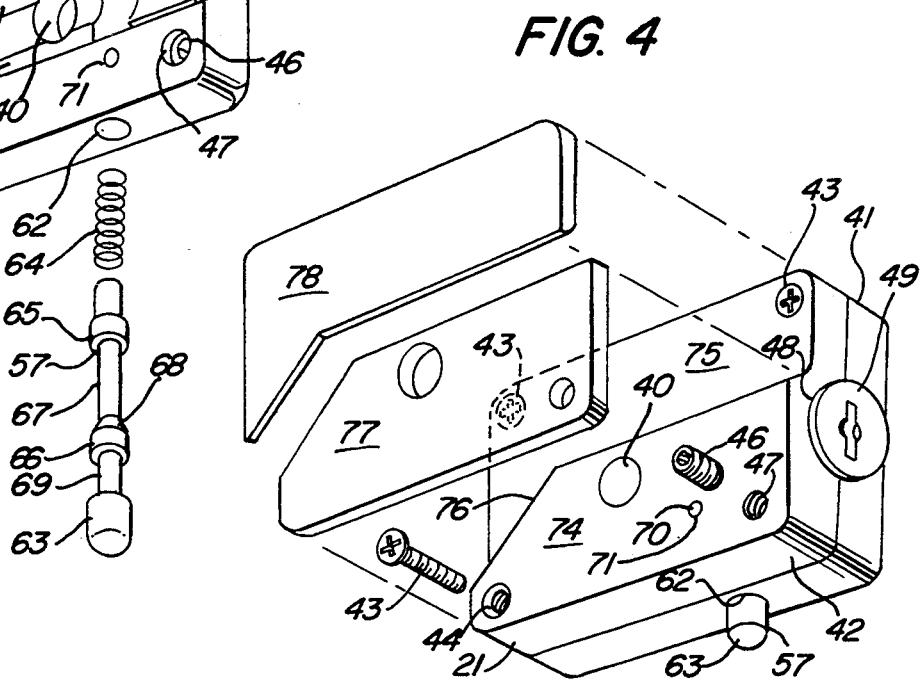
FIG. 4 is an exploded perspective view of the pseudo lock half of the gun trigger blocking structure.
Figure 7:
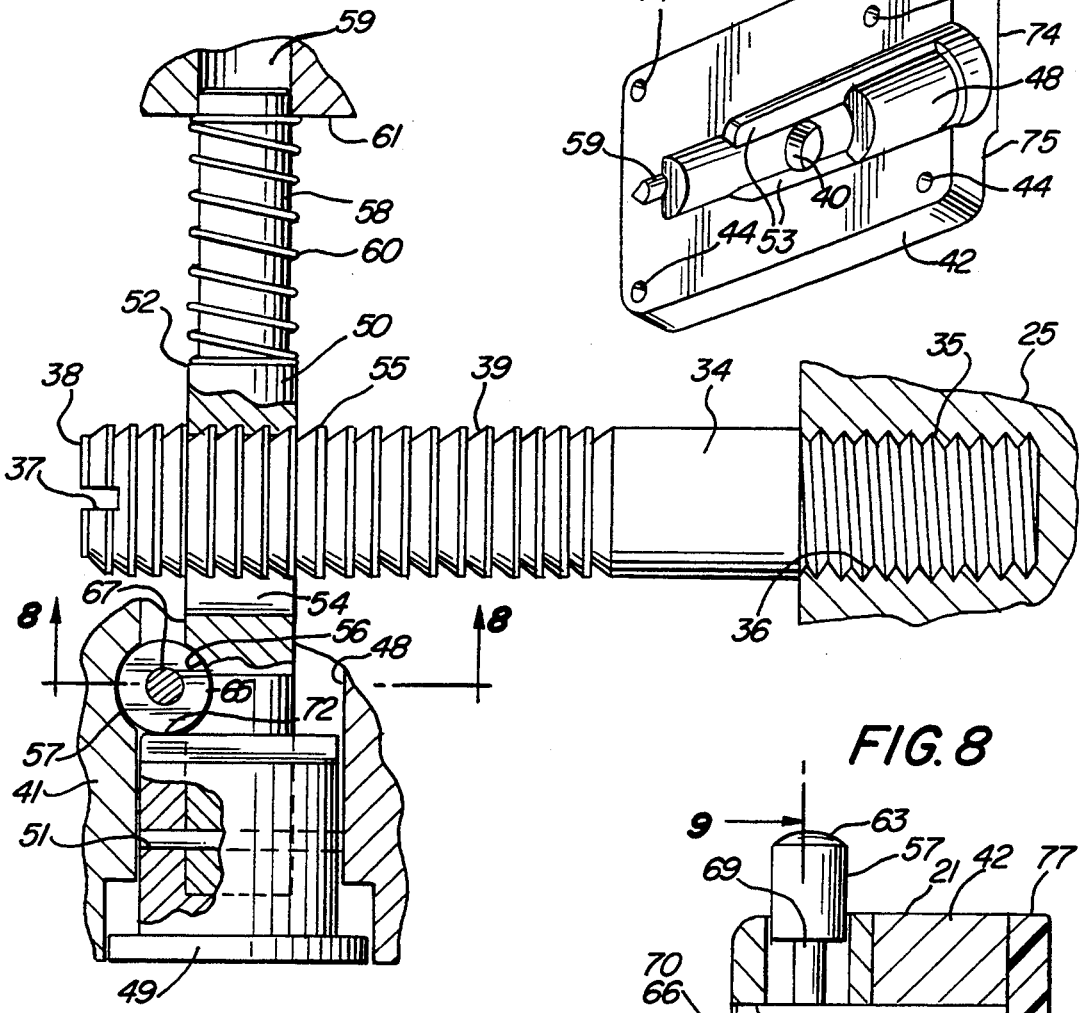
FIG. 7 is a partial cut away and enlarged sectioned view taken generally along line 7—7 of FIG. 3 showing locking rod buttress thread engagement with opening buttress threads of the pseudo key member extension detail.

A locking rod 34 as shown in FIGS. 3 and 7 is mounted in locking structure half 25 by threads 35 thereon being threaded into threaded opening 36 as driven with screw driver notch 37 in the outer end 38. The locking rod 34 is provided with buttress threads 39 extending through the greater exposed portion thereof from the outer end 38 down that is insertable into opening 40 in pseudo lock half 21 of the gun trigger blocking structure 20. The pseudo block half 21 is shown to have two portions, an outer portion 41 and an inner portion 42, that are fastened together by three corner screws 43 that extend through corner openings 44 in inner portion 42 into threaded openings 45 in outer portion 41 and an allen head set screw 46 threaded into the threaded opening 47 extended through a part of both the inner and outer portions 42 and 41. The allen head end of set screw 46 as seen in FIG. 4 is a position limit setting for the end of cover pin 29 when inserted into opening 47.

Figure 5:
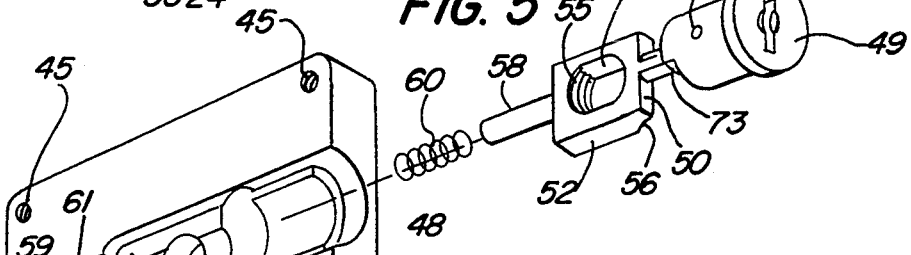
FIG. 5 is an exploded perspective view of the outer portion of the pseudo lock half of the gun trigger blocking structure.
Figure 6:
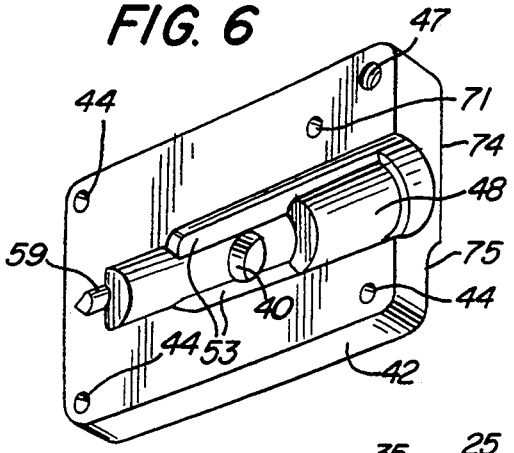
FIG. 6 is a perspective view of the inner portion of the pseudo lock half of the gun trigger blocking structure.
Figure 8:
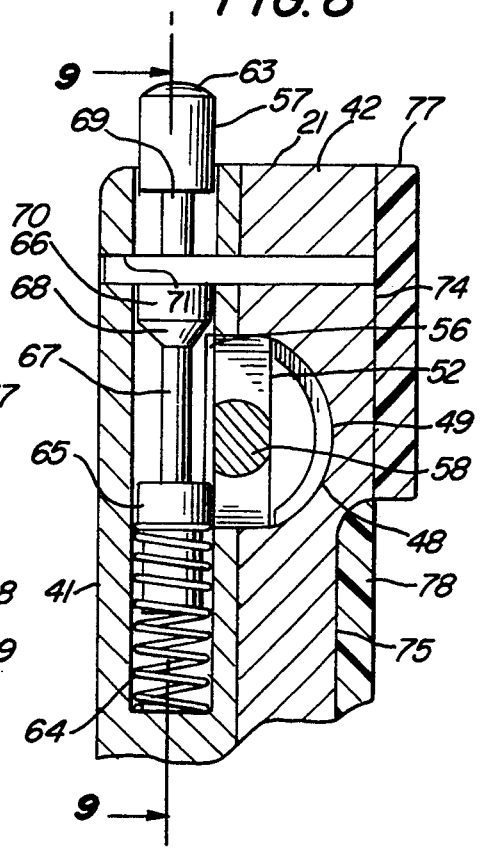
FIG. 8 is a partial cut away and sectioned view taken along line 8—8 of FIG. 7 showing blocking pin detail in the blocking state preventing movement of the pseudo key member toward its inner limit position.
Figure 9:
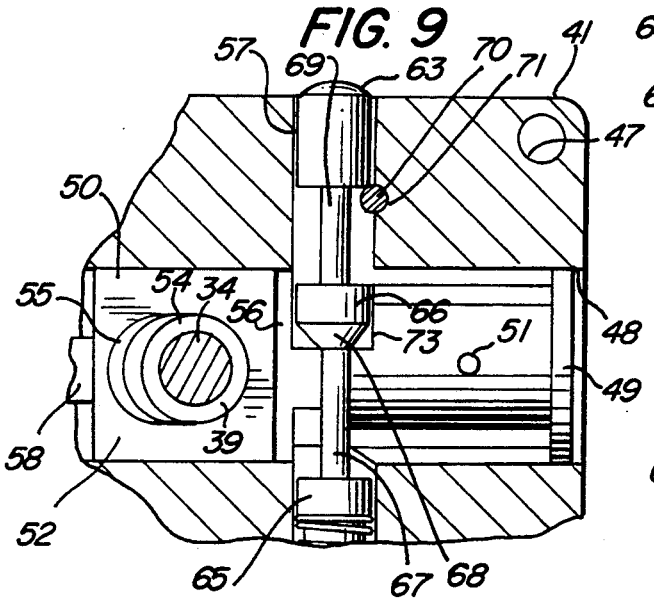
FIG. 9 is a partial cut away and sectioned view taken along line 9—9 of FIG. 8 showing the blocking pin pushed into its unblock position permitting movement of the pseudo key member to its inner limit position.

Referring also to FIGS. 5 and 6 the pseudo lock half 21 outer portion 41 and the inner portion 42 have an opening 48 in which what appears to be a key lock tumbler (or lock cylinder) 49 is positioned. While appearing to be a lock requiring a key for operation, it is actually a pseudo lock element 49 that is moveable back and forth, along its longitudinal axis, to a limited extent within the opening 48 . Opening 48 extends on back within the pseudo lock half 21 from the front portion thereof containing pseudo lock element 49 to contain an axially slidable extension 50 that is pin 51 (or screw) connected to pseudo lock element 49. The axially slidable extension 50 is formed with a flat rectangular portion 52 slidable along and between flat ledge sections 53 in opening 48 in the region and spanning opening 40 and with an opening 54 through the flat rectangular portion 52 into and through which the buttress threaded 39 portion of locking rod 34 is inserted when the locking structure half 25 and the pseudo lock half 21 are connected together as trigger blocking structure 20. Buttress thread engaging grooves 55 are provided on the back side of opening 54 in flat rectangular portion 52 that engage and capture buttress threads 39 on the locking rod 34 when it is inserted through opening 54 with the pseudo lock element 49 along with the extension 50 axially biased to a forward or outer position with relieved corner section 56 in contact with blocking pin 57. A stub rod 58 extends to the rear from the flat rectangular portion 52 and at the end into a guide hole 59 therefor. A coil spring 60 resiliently compressed on stub rod 58 between the rear end of the flat rectangular portion 52 and internal shoulder 61 in opening 48 at the start of rod guide hole 59. Thus, the flat rectangular portion 52 with opening 54 buttress thread engaging grooves 55 is resiliently biased along the longitudinal axis of the pseudo key lock element 49 toward an outer position by the spring 60 so that the lock element 49 is normally in its outer position shown in FIGS. 3 and 4.

Referring to FIGS. 5 and 7 and also 8 and 9 the blocking pin 57, inserted in opening 62 in the outer portion 41 of the pseudo lock half 21, is resiliently biased toward on outer position with end 63 extended to the exterior from outer port ion by a coil spring 64 compressed between the bottom of opening 62 and an annular shoulder 65 on the pin 57. The blocking pin end 63, and intervening annular ring 66 and annular shoulder 65 are all substantially the same diameter, that is, a sliding fit in opening 62. The smaller diameter portion 67 of pin 57 extends between annular shoulder 65 and the conical face 68 of annular ring 66, and a shorter reduced diameter portion 69 of pin 57 interconnects annular ring 66 and pin end 63. A position limiting pin 70 is inserted in opening 71 in the pseudo lock half 21 to extend into opening 62 and between annular ring 66 and pin end 63. The pin 70 limits the range of movement of blocking pin 57 between its outer blocking position and its inner unblocking position where the pseudo key lock tumbler (or lock cylinder) 49 and the extension 50 are permitted to be pushed from their outer position to the inner position. In the inner position the buttress thread engaging grooves 55 clear the buttress threads 39 to release locking rod 34 and permit separation movement of the pseudo lock half 21 from locking structure half 25 and removed thereby from a gun it was installed on.

The inner end of the lock cylinder 49 adjacent to blocking pin 57 has an arcuate relief surface 72 that engages the annular shoulder 65 when the pseudo key lock tumbler (or lock cylinder) 49 is in the outer blocked position state. Then when the blocking pin 57 is pushed in, the lock cylinder 49 may be pushed inward until arcuate relief surface 72 contacts the smaller diameter portion 67 of the pin thereby establishing the inner limit position of the lock cylinder 49 and its extension 50 thereby disengaging the buttress thread engaging grooves 55 from buttress threads 39 on locking rod 34 for release. A notch cut out 73 is also provided on the inner end of the lock cylinder 49 to provide clearance for the annular ring 66 of blocking pin 57 when the pin is pushed inwardly.

While pseudo lock half 21 of the gun trigger blocking structure 20 has been shown and described as having two portions, an outer portion 41 and an inner portion 42, it could be molded in one piece (even of a suitable plastic material) and still provide the same operational results. In any event, the inner face of the pseudo lock half 21 has a higher level 74 and a recessed level 75 that is enlarged at one end at angle 76. Correspondingly resiliently compressible pads 77 and 78 are fastened in place thereon as by an adhesive and are depressible to some degree by the outer ends of pins 33 that may be in contact therewith and to pad contact with gun structure the structure 20 is used on. Locking structure half 25 has an inner face with a higher level 79 and a recessed level 80 also enlarged at one end at angle 81 so that the two level inner face thereof is a mirror image of that of pseudo lock half 21. The opposite halves of the structure are so shaped to better adapt to the configuration of a gun the trigger blocking structure 20 is mounted on. It should be noted that the gun trigger blocking structure 20 may be mounted horizontally on a gun as shown in FIG. 2 or vertically as would be required with some rifles and/or shotguns or even, in some instances, at an angle between horizontal and vertical.

Whereas this invention has been described with respect to a single embodiment thereof, it should be realized that various changes may be made without departure from the essential contributions to the art made by the teachings hereof.

What is claimed is:

1. A gun trigger blocking structure comprising:

a first block half having a pseudo key lock cylinder movable between outer and inner positions therein;

an extension fastened to said pseudo key lock cylinder extending rearwardly from the cylinder within a first opening in said first block half and an opening through said extension with a thread engaging grooved section;

blocking pin means moveable between outer and inner positions in said first block half;

blocking pin resilient bias means in said first block half biasing said blocking pin means from said blocking pin means inner position toward said blocking pin means outer position;

said blocking pin means shaped and positioned such that when in its outer position in said first block half it blocks movement of said pseudo key lock cylinder from its outer position toward its inner position; and when said blocking pin means is moved to its inner position it permits movement of said pseudo key lock cylinder and said extension from the outer position to the inner position;

a second block half;

locking rod means mounted in said second block half and equipped with threads on an outer end insertable into the opening through said extension to locked engagement with said thread engaging grooved section when said pseudo key lock cylinder and said extension are in the outer position, and with movement of said pseudo key lock cylinder and extension to the inner position lock disengagement of the said thread engaging grooved section from the threads on the outer end of said locking rod means; and projection means extending from at least one of said first and second block halves positioned to block movement of a gun trigger the trigger blocking structure is mounted on.

2. The gun trigger blocking structure of claim 1 further including an extension resilient bias means within said first block half for resiliently biasing the pseudo key lock cylinder and said extension toward said outer position.

3. The gun trigger blocking structure of claim 2 wherein said blocking pin resilient bias means and said pseudo key lock cylinder and said extension resilient bias means are both resiliently compressible coil springs seated in said first block half.

4. The gun trigger blocking structure of claim 2 wherein said threads on an outer end of said locking rod means are buttress threads and said thread engaging grooved section is a section of buttress thread engaging grooves engageable with the buttress threads on said locking rod means.

5. The gun trigger blocking structure of claim 4 wherein said first and second block halves have inner faces that face each other in spaced relation when they are assembled together as said gun trigger blocking structure, a plurality of pin receiving openings in at least one of said inner faces, and with said projection means being a plurality of pins selectively placed in various openings of said plurality of pin receiving openings for positioning to block movement of a gun trigger and to aid in the mounting of trigger blocking structure on a gun.

6. The gun trigger blocking structure of claim 5 wherein a plurality of pins are each provided with a conical insert section for convenience of insertion thereof in various openings of said plurality of pin receiving openings.

7. The gun trigger blocking structure of claim 6 wherein said plurality of pins are provided with plastic cup covers.

8. The gun trigger blocking structure of claim 6 wherein resiliently compressible padding is mounted on at least one inner face of the inner faces of said first and second block halves.

9. The gun trigger blocking structure of claim 8 wherein outer ends of said plurality of pins mounted in the inner face of one of said first and second block halves contact resiliently compressible padding mounted on the inner face of the other of said first and second block halves.

10. The gun trigger blocking structure of claim 8 wherein both inner :faces of said first and second block halves each have a higher level and a recessed level opposite each other when the first and second block halves are assembled together to better adapt to the configuration of a gun the trigger blocking structure is mounted on.

11. The gun trigger blocking structure of claim 10 wherein a corner pin extends from mounting in one of said first and second block halves into pin opening means in the other of said first and second block halves, and removal restraining means is fastened to said corner pin.

12. The gun trigger blocking structure of claim 11 wherein said pin opening means is a threaded opening, an allen head screw threaded into said threaded opening adjustable as a position limit setting for an end of said corner pin when inserted into said pin opening means when said first and second block halves are assembled together.

13. The gun trigger blocking structure of claim 4 wherein said extension fastened to said pseudo key lock cylinder is formed with a flat rectangular portion, flat ledge means in said first opening supporting said flat rectangular portion of said extension and along which said flat rectangular portion slides, and with said opening through said extension being an opening through said flat rectangular portion.

14. The gun trigger blocking structure of claim 13 wherein said thread engaging grooved section is on the back side of said opening through said flat rectangular portion.

15. The gun trigger blocking structure of claim 14 wherein said extension includes a stub rod that extends to the rear from said flat rectangular portion, and in which a resiliently compressible coil spring biases said pseudo key lock cylinder and said extension, the coil spring being positioned on said stub rod and in said first opening.

16. The gun trigger blocking structure of claim 15 wherein said blocking pin means is a pin with an outer head and an annular ring separated by a first reduced diameter portion and then an annular shoulder separated from said annular ring by a second reduced diameter portion longer than said first reduced diameter portion, and an innermost stub end supporting the resiliently compressible coil spring of said blocking pin in a blocking pin hole in said first block half.

17. The gun trigger blocking structure of claim 16 wherein a position limiting pin is inserted in an opening in said first block half passing eccentrically through said blocking pin hole and in the space between said outer head and said annular ring of said blocking pin means to establish an outer limit position of said blocking pin means by contact with said annular ring and an inner limit position by contact with said outer head.

18. The gun trigger blocking structure of claim 17 wherein said pseudo key lock cylinder with said extension is resiliently biased to the outer position with a forward cut out relieved corner on said flat rectangular portion in contact with the outer surface of the annular shoulder of said blocking pin means blocking outward movement of the extension and said pseudo key lock cylinder.

19. The gun trigger blocking structure of claim 18 wherein when said blocking pin means is pushed to its inner position, the pseudo key lock cylinder and its extension may be pushed to its inner position clearing the blocking pin annular shoulder with surface means on the back of said pseudo key lock cylinder coming into movement limiting contact with said second reduced diameter portion of said blocking pin to thereby disengage said buttress thread engaging grooves from buttress threads on the locking rod.

20. The gun trigger blocking structure of claim 19 wherein there is a locking rod receiving opening in said first block half permitting insertion of said locking rod in said first block half and passage thereof through the opening in the extension of said pseudo keylock cylinder, and with the rear of said pseudo key lock cylinder having a cut out insuring clearance of said pseudo keylock cylinder from the annular ring of said blocking pin means in its inner position to permit movement of said pseudo key lock cylinder to its inner position.

21. A gun trigger blocking structure comprising:

a) first and second block halves adapted to be mounted on opposite sides of a gun trigger guard;

b) a locking member mounted on one of the block halves and arranged to extend into an opening in the other block half;

c) locking member engaging means including a pseudo key lock mounted in the other block half, the pseudo key lock being moveable between first and second positions, the locking member engaging means being arranged to engage the locking member and prevent separation of the block halves when the pseudo key lock is in the first position and to disengage the locking member and allow the block halves to be separated when the pseudo key lock is in the second position;

d) means for selectively preventing the pseudo key lock from moving from the first to the second position; and e) means extending from at least one of the block halves for blocking movement of a trigger of a gun on which the trigger blocking structure is mounted.

22. The invention of claim 21 wherein the locking member engaging means includes a spring for biasing the pseudo key lock to its first position.

23. The invention of claim 22 wherein the pseudo key lock is moveable along a longitudinal axis between the first and second positions thereof.

24. The invention of claim 23 wherein the pseudo key lock defines a longitudinal axis and wherein the locking member extends perpendicular to the longitudinal axis of the pseudo key lock when the block halves are secured together.

25. The invention of claim 24 wherein the locking member is a rod.

26. The invention of claim 25 wherein the portion of the rod which extends into the opening in the other block half is threaded.

27. The invention of claim 25 further including a blocking pin slidably mounted in the other block for selectively preventing the pseudo key lock from moving from the first to the second position.

28. A gun trigger blocking structure comprising:

a) first and second block halves;

b) a pseudo key lock cylinder mounted in the first block half moveable between an inner and outer position;

c) a blocking pin mounted in the first block half and moveable between first and second positions, the blocking pin when in the first position preventing the pseudo key lock cylinder from moving from the outer to the inner position and when in the second position allowing the key lock cylinder to move to the inner position;

d) a locking member mounted in the second block half and arranged to extend through an opening in the first block half when the first and second block halves are positioned on opposite sides of a trigger guard;

e) means mounted within the first block half responsive to the pseudo key lock cylinder in the outer position for engaging the locking member to prevent the locking member from being withdrawn from the first block half and responsive to the pseudo key lock cylinder in the inner portion for disengaging the locking member to allow the locking member to be withdrawn from the first half block; and f) means extending from at least one of the block halves positioned to block movement of a trigger of a gun on which the trigger locking structure is mounted.

29. The invention of claim 28 wherein the means for selectively engaging and disengaging the locking member is formed as an extension to the pseudo key lock.

30. The invention of claim 29 wherein the extension of the pseudo key lock defines an opening for securing the locking member.

31. The invention of claim 30 wherein the locking member is in the form of a threaded rod and the opening in the extension has cooperating threads on a portion thereof.

* * * * *